US005326056A

United States Patent [19]

Smith

[11] Patent Number: 5,326,056

[45] Date of Patent: Jul. 5, 1994

[54] HAND REST

[76] Inventor: Heidi A. Smith, P.O. Box 21411, Oklahoma City, Okla. 73156-1411

[21] Appl. No.: 911,403

[22] Filed: Jul. 10, 1992

[51] Int. Cl.[5] ..... B68G 5/00

[52] U.S. Cl. ..... 248/11.8; 132/73

[58] Field of Search ..... 248/118, 118.1; 108/32; 132/73, 73.5

[56] References Cited

U.S. PATENT DOCUMENTS

| | | | |
|---|---|---|---|
| 1,500,649 | 7/1924 | Simonson | 132/73.5 |
| 1,844,698 | 2/1932 | Snyder | 132/73.5 |
| 2,147,314 | 2/1939 | Percy | 132/73 |
| 3,056,968 | 10/1962 | Fitzpatrick | 132/73 |
| 4,329,002 | 5/1982 | Cowen | 132/73 |
| 4,441,487 | 4/1984 | Daugherty | 132/73 X |
| 4,852,468 | 8/1989 | Harris | 132/73 X |
| 4,915,331 | 4/1990 | Becker | 132/73 X |
| 4,943,462 | 7/1990 | Komerska | 132/73 X |
| 5,169,103 | 12/1992 | Jimenez | 248/118 |
| 5,184,795 | 2/1993 | Sexton | 248/118 |

*Primary Examiner*—J. Franklin Foss

*Attorney, Agent, or Firm*—Lynndon Michael Guard

[57] ABSTRACT

A device which provides support for the wrists, forearms and hands of both a manicurist and the person receiving the manicure while a manicure is being performed. The invention is designed to be able to be custom fitted to any work area regardless of the size including those work areas which have a ventilation system built into them.

15 Claims, 6 Drawing Sheets

HAND REST

BACKGROUND OF THE INVENTION

1. Field of the Invention

The field of this invention is devices used by persons manicuring nails. More specifically, the field of the invention is devices for the support of the hands, wrists and forearms of the person being manicured and of the manicurist.

2. Description of the Related Art Including Information Disclosed Under 37 CFR Section 1.97–1.99

The inventor has searched the current market place and had a patent search performed for the invention in question. The inventor was not able to locate any device that could act as support for the working hands, wrists and forearms of a manicurist, let alone perform all of the functions that the present invention is capable of. Most of the prior art located provided means for support of the hands or forearms of the person receiving the manicure but none of them provide means of support for the working hands, wrists and forearms of the manicurist to prevent strain commonly experienced by a manicurist in her forearms, wrists and hands. Prior art teaches the desirability of providing for comfortable support of the hands or forearms of the person receiving the manicure, to keep their hands relaxed, but none of the prior art even suggests any reason for or means to support the hands, wrists and forearms of the manicurist.

While no product was located on the market that could act as a support for the working hands, wrists and forearms of a manicurist and at the same time provide support for the hands and forearms of the person receiving the manicure, a patent search did disclose the material prior art set forth hereinbelow. All of the material prior art, of which Applicant is aware, is set forth hereinbelow and copies of the patents and other prior art described hereinbelow are submitted herewith.

U.S. Pat. No. 1,500,649, Manicuring Table, issued Jul. 8, 1924, inventor Leo B. Simonson, shows a manicure table and in relevant part a round cushion which is for the support of the hand of the person being manicured. However, Simonson's Manicure Table does not teach a means of support for the manicurist's hands nor does it provide a support for the hand of the person being manicured which can be used on any table.

U.S. Pat. No. 1,844,698, Manicuring Set, issued Feb. 9, 1932, inventor Louis Snyder, shows a manicure table designed for use with a barber's chair and in relevant part a rectangular pad or rest for the hand being manicured. Again, Snyder's Manicuring Set does not teach a means of support for the manicurist's hands nor a support for the hand of the person being manicured which can be used on any table.

U.S. Pat. No. 2,147,314, Manicuring Table, issued Feb. 14, 1939, inventor Paul Percy, shows a manicuring table which provides both a support for the hand being manicured as well as an arm rest for the arm of the hand being manicured. However, Percy's Manicuring Table does not teach a means of support for the manicurist's hands nor a support for the hand of the person being manicured which can be used on any table.

U.S. Pat. No. 3,056,968, Manicuring Aid, issued Oct. 9, 1962, inventor Evelyn D. Fitzpatrick, shows a support for the hand being manicured which could be used on any table. However, Fitzpatrick's Manicuring Aid is not capable of supporting the working hands of the manicurist.

U.S. Pat. No. 4,329,002, Manicure Table, issued May 11, 1982, inventors Theodore A. Cowen and Gary B. Jackovin, shows a manicure table which has a padded inclined plane to support the forearm of the person receiving the manicure. The Cowen and Jockovin patent teach the desirability and need to have the hands of the person receiving the manicure relaxed. However, it does not teach of the desirability of or provide for a comfortable support for the manicurist's forearms, wrists and hands.

The enclosed copies of a dina meri® sales brochure depict the following relevant products: the 341VS Portable Nail Air Filter System and three vented manicuring tables (the 371-DLX, the 390-DLX and the 351-DLX) which all provide a padded armrest for the hand being manicured. However, none of dina meri® products provide a means of support for the manicurist's hands. Applicant has no relationship or association with dina meri®. The dina meri® sales brochure may prove useful in understanding certain species of the invention that is the subject of this application as will be explained hereinbelow in more detail be cause some species have been designed to be used in conjunction with some of the depicted dina meri® products.

None of the above referenced prior art teaches of the desirability of providing a comfortable support for the hands, wrists and forearms of the manicurist to avoid strain nor do any of them provide any such support. The present invention provides both comfortable support for the hands, wrists and forearms of the person receiving the manicure as well as comfortable support of the hands, wrists and forearm of the manicurist. At the same time the present invention raises the height at which the manicurist will work and is capable of being easily resized to fit on any given flat surface. None of the above referenced prior art suggests the combination of the separate features of support for the hands, wrists and forearms of the person receiving the manicure with support of the hands, wrists and forearm of the manicurist.

SUMMARY OF THE INVENTION

The invention was designed to provide a comfortable raised support for the wrists, forearms and hands of a person that is performing a task, such as a manicure, for extended periods of time which requires the person doing the work to hold their hands in a relative fixed position in relation to their forearms that can be not only uncomfortable but cause strain in the their hands, wrists or forearms. The invention is designed to assist in the manicuring of nails by also providing support of the hands, wrists and forearms of the person receiving the manicure.

Figure 1:
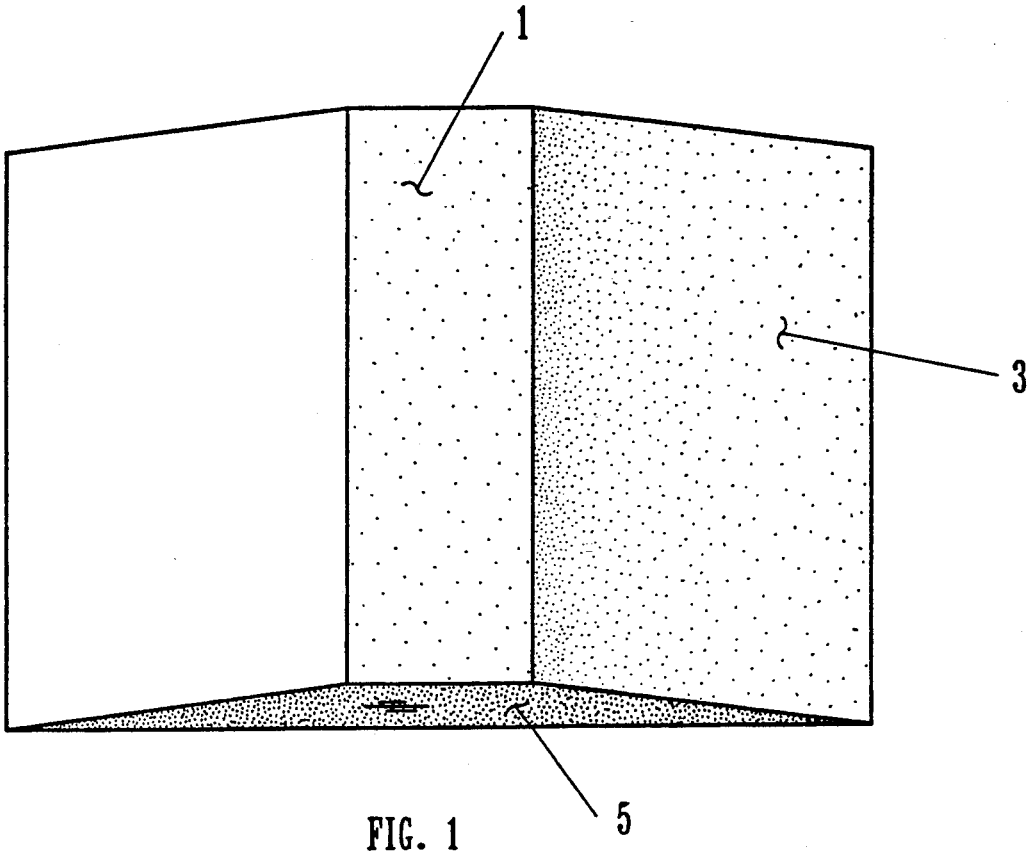
FIG. 1 shows a top view of the specie of the invention called the Double Wedge or the D-Wedge.

REFERENCE NUMERALS IN DRAWINGS 1 top/work surface,
3 sloped surface,
5 side wall,
7 ventilation ports,
9 interior side wall,
11 interior sloped side wall,
13 interior side wall cutaway surface,
15 sloped side wall, and
17 end surface.

DETAILED DESCRIPTION

The invention was designed as an aid to professional manicurists who frequently have to spend hours bent over working on another person's nails. The invention raises the working surface where the person who is receiving the manicure rests their hand by providing support for their hands, wrists and forearms so the manicurist does not have to bend over as far, thus improving the posture of the manicurist. Additionally, the invention provides means to support the hands, wrists and/or forearms of the manicurist thus preventing commonly experienced strain in the hands, wrists and forearms of the manicurist. It is known that some manicurists have developed carpal tunnel syndrome and it is believed that use of the hand rest will help prevent carpal tunnel syndrome from occurring. It is believed that it is the combination of providing a raised work surface, proper support for the hands, wrists and forearms of the manicurist as well as support for the hands, wrists and forearms of the person being manicured that is the heart of this invention.

FIG. 1 shows a side view of the most basic embodiment of the hand rest which is called the Double Wedge or the D-Wedge. In this embodiment of the invention there are only six surfaces of the invention. Reference numbers 1 through 5 identify three of the surfaces of the invention. As is reflected there is a mirror image surface to sloped surface 3 which is not numbered, on the other side of Top 1 in FIG. 1. Additionally, side surface 5 has a mirror image surface which can not be seen in FIG. 1 but which is parallel to side wall 5. Both of the mirror image surfaces have the same dimension and proportions as surfaces 3 and 5, their mirror image counterpart. A bottom surface is not shown but is parallel to top surface 1 and perpendicular to side surface 5. The bottom surface o f the preferred embodiments of the invention are flat surfaces.

Figure 2:
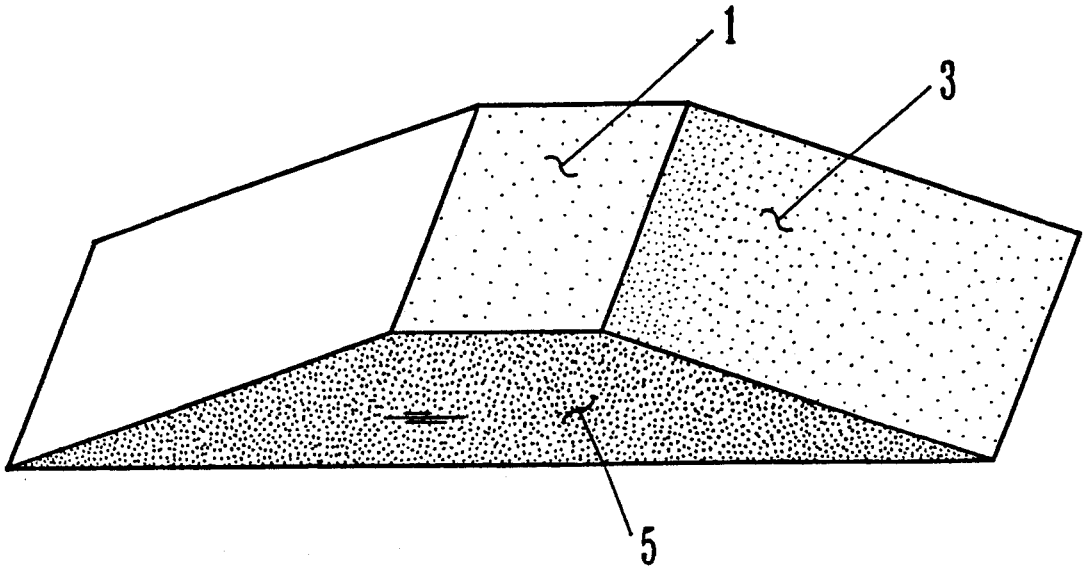
FIG. 2 shows a side view of the specie of the invention called the Double Wedge or the D-Wedge.

FIG. 2 shows a side view of the same embodiment of the invention as is reflected in FIG. 1. Again the bottom surface cannot be seen, nor can the mirror image surface to side wall 5 be seen, but neither of these two surfaces are necessary to be seen to provide a full understanding of the invention. In the preferred embodiment of the Double Wedge the height of the side wall is two (2) inches, the length of the bottom surface is nineteen (19) inches and the width of the bottom surface is sixteen (16) inches. The width of top surface 1 is about six (6) inches and the length of top surface 1 is sixteen (16) inches. The angle between the sloped surface 3 and the bottom surface is about seventeen (17) degrees. The proportions and actual size of the Double Wedge were arrived at through experimentation and these proportions and dimension are considered ideal by the inventor to provide the necessary support and comfort to both the manicurist and the person receiving the manicure.

Figure 3:
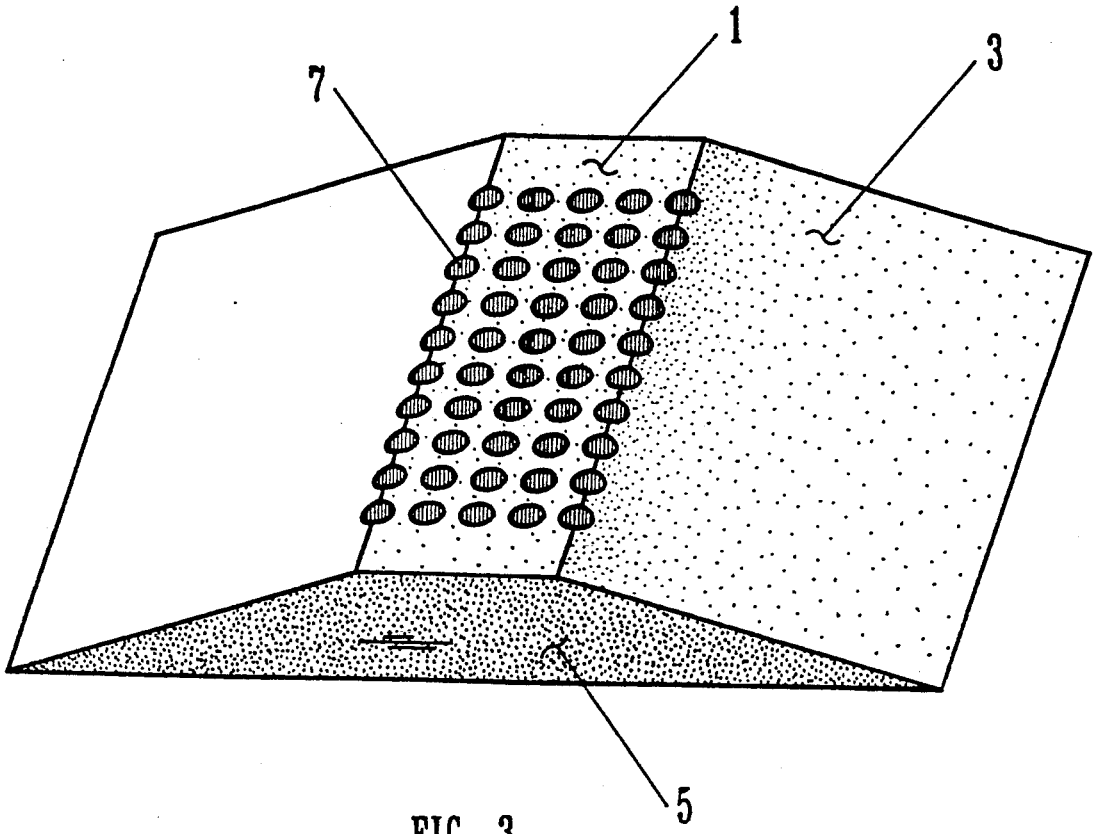
FIG. 3 shows a top view of the specie of the invention called the Vented Wedge.

FIG. 3 shows a top view of an embodiment of the invention called the Vented Wedge. This embodiment was designed to work in conjunction with manicurist's tables that have ventilation systems built into the surface of the table, such as the tables reflected in the enclosed dina meri® brochures. Specifically, the dina meri® tables 331-DLX, 351-DLX and 371-DLX, as shown in the enclosed brochures, all have the type of ventilation system being referred to. By placing the plurality of air ports 7 (ventilation holes) of the invention directly over and above the vent system of the table, the utility of the ventilation system in the table is not lost while at the same time retaining all the desirable properties of the Double Wedge. The purpose of the ventilation system is to remove airborne particles and gases which result from various manicure techniques, from the immediate area of the manicurist.

Figure 4:
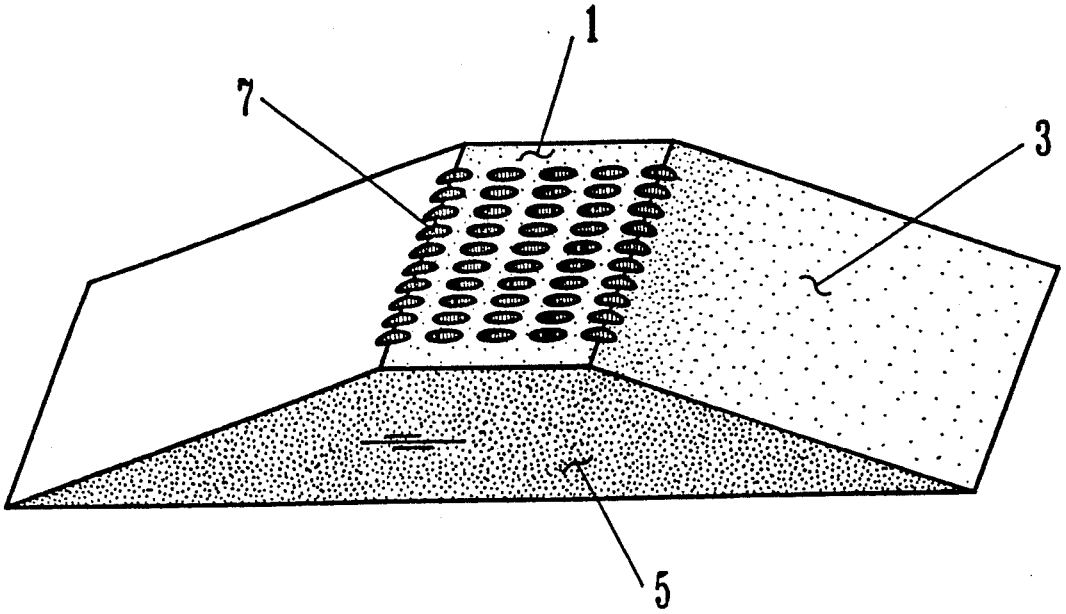
FIG. 4 shows a side view of the specie of the invention called the Vented Wedge.

FIG. 4 shows a side view of the Vented Wedge. Other than the existence of a plurality of air ports 7, there are no fundamental differences between the Double Wedge and the Vented Wedge. However, the Double Wedge and the Vented Wedge are different sizes. The dina meri® tables 331-DLX, 351-DLX and 371-DLX are narrow and therefore the Vented Wedge is smaller than the Double Wedge to fit on the surface of the dina mari® tables. The side wall 5 is sixteen (16) inches in leneth and two (2) inches in height. The top/-working surface 1 and the sloped surface 3 are five and one half (5½) inches wide and sixteen inches long. The bottom surface, not shown, is flat and sixteen (16) inches in width and length. The angle between the sloped surface 3 and the bottom surface is about 20 (20) degrees.

Figure 5:
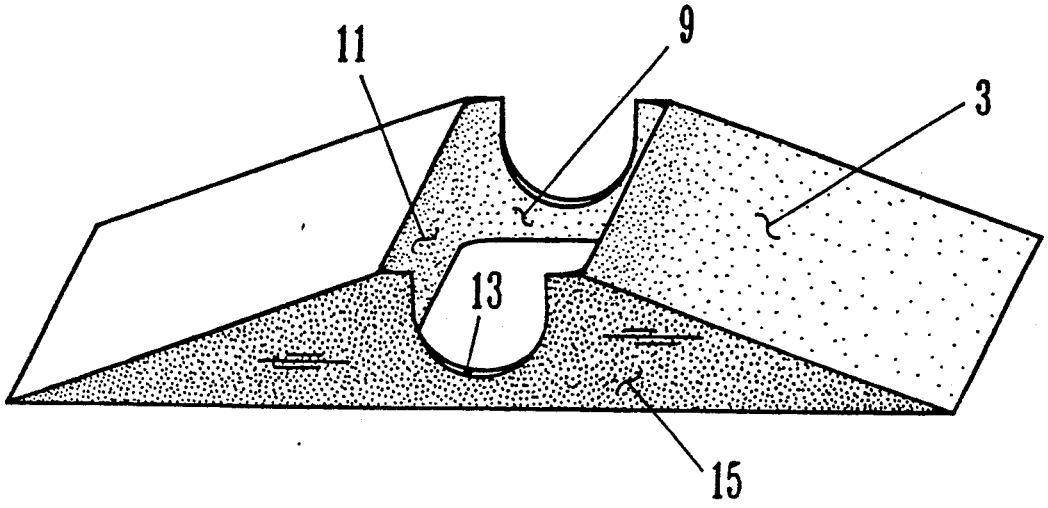
FIG. 5 shows a top/side view of the specie of the invention called the D.M. Vented Wedge.

FIG. 5 shows an angled top view of an embodiment of the invention called the D.M. Vent Wedge. This embodiment was designed to work in conjunction with the 341VS Portable Nail Air Filter System by dina meri® which is reflected and described in the enclosed dina meri® brochures. Specifically, this embodiment of the invention fits around the dina meri® 341VS Portable Nail Air Filter System without obstructing the air flow of the 341VS when it is in operation. By placing the 341VS Portable Nail Air Filter System down inside the cavity of the D.M. Vent Wedge, so as to align the two side air vents on the 341VS with the U shaped openings of the sloped side wall 15, the utility of the 341VS's ventilation system is not lost while at the same time retaining all the desirable properties of the Double Wedge.

Figure 6:
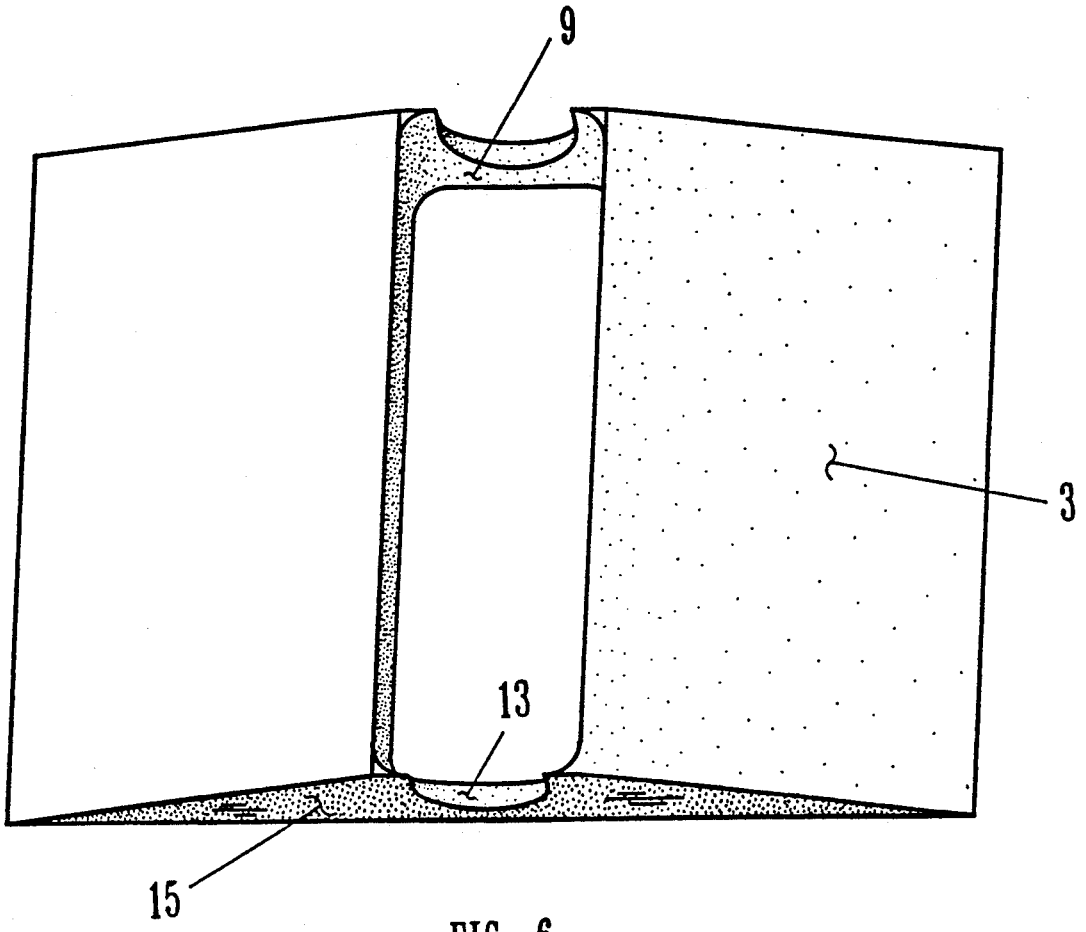
FIG. 6 shows a side view of the specie of the invention called the D.M. Vented Wedge.

FIG. 6 shows a side view of the D.M. Vent Wedge and a better perspective of the U shaped openings in the sloped side wall 15. The interior side wall cutaway surface 13 is the surface area between the interior side wall 9, and the sloped side wall 15. Only the edge of end surface 17 is visible in FIG. 6.

The proportions of the D.M. Vented Wedge are different from the either of the above described embodiments of the invention in order to accommodate the 341VS's height of three inches while still providing comfortable support for the hands, wrists and forearms of the manicurist, as well as the person being manicured.

Interior side wall 9, interior sloped side wall 11, interior side wall cutaway surface 13, sloped side wall 15, and end surface 17 all have unnumbered mirror image surfaces. The mirror image surfaces of the interior side wall 9, interior sloped side wall 11, and end surface 17 all are parallel to their mirror image and perpendicular to the bottom surface. The height of the interior side wall 9 and interior sloped side wall 11 is three inches. The length of the interior side wall 9 is seven and one half (7½) inches. The length of the interior sloped side wall 9 is sixteen (16) inches. The length of the bottom surface, which cannot be seen in FIG. 6, and sloped side wall 15 is twenty-three (23) inches. The width of the bottom surface and the end surface 17 is eighteen (18) inches. The height of end surface 17 is one inch. The height of the U shaped opening in sloped side wall 15 is two (2) inches and it is three (3) inches in diameter.

The support wedge is composed of of cushioning material, and in the preferred embodiment, ethylene vinyl acetate. While there are many other possible materials available, the inventor selected ethylene vinyl acetate as the preferred material because it provides the necessary firmness to work on while at the same time being flexible and soft enough to be a comfortable surface to work on, does not slide around on any surface it could be placed on so it provides adiquate friction between the invention and a table top. Ethylene vinyl acetate also does not allow towels to slip around which are placed over it to form a sanitary surface to work on. Additionally, ethylene vinyl acetate provides the benefit of allowing the length of the Double Wedge to be shortened to be custom fitted to any working surface, such as a table top, with a pair of scissors. The length of the Double Wedge, the length between the opposite edges of the bottom which have a common edge with the sloping surfaces, can be easily shortened by the manicurist by cutting strips parallel to the edges of the Double Wedge which are the common edges to the bottom and the two sloping surfaces. The invention is so thin near the common edge between the bottom and the sloping edges that it is easy to cut strip(s) off with scissors.

The best known way to manufacture the invention is to hand produce them utilizing equipment designed to cut ethylene vinyl acetate foam, which are known to the industry, which have vertical, horizontal and a tilt head saw. It is the inventor's understanding that the invention can not be molded and that each hand rest must be cut from large buns of ethylene vinyl acetate.

For situations where a manicurist already has adequate support for the forearms of a person to receive the manicure, a specie of the invention is manufactured in different sizes that does not provide a second sloped surface. Instead a back wall, perpendicular to top/work surface 1 and side walls 5 can connect to the bottom. This specie would also be useful to any person that is performing tedious tasks for extended periods of time which requires the person doing the work to hold their hands in a relative fixed position in relation to their forearms that can be not only uncomfortable but cause 20 strain in the their hands, wrists or forearms.

It should be evident that variations can be made within the scope of the invention. The invention is not intended to be restricted to the particular constructions specifically identified and shown herein, nor to the particular applications of such construction, as the same may be modified in various particulars or be applied in many varied relations without departing from the spirit and scope of the invention, a practical embodiment of which has been herein illustrated and described without attempting to show all the various forms and modifications in which the invention might be embodied. It will also be evident that other variations can be made within the scope of the invention and such variations are within the scope of the claims.

I claim:

1. In a device for use by a manicurist while giving another person a manicure while having a table, with a ventilation system built into the surface of the table designed to remove particles and fumes from the air around the manicurist to work on, such as a dina meri® vented table, the device comprising:

a) means for supporting the hands, wrists and forearms of the manicurist;

b) means for supporting the hands, wrists and forearms of the person receiving the manicure; and c) means for allowing the vent system built into the table to continue its function unimpaired;

so as to allow the device to be placed on the dina meri® vented table aligning the means for allowing the vent system to properly function directly over the vent in the surface of the table between the manicurist and the other person, provide comfortable support for the person receiving the manicure, provide comfortable support for the manicurist's hands, wrists and forearms while performing the manicure and allowing the vent system to function properly.

2. A device according to claim 1 wherein the device is composed of resilient material.

3. A device according to claim 1 wherein the device is composed of ethylene vinyl acetate.

4. A device according to claim 2 further comprising:

a) a bottom surface;

b) a top/work surface parallel to the bottom surface;

c) two side walls of equal size and shape connecting opposite edges of the top/work surface to opposite edges of the bottom surface;

d) two sloped surfaces of equal size and shape connecting the remaining two opposite edges of the bottom surface to the remaining two opposite edges of the top/work surface;

such that the person receiving the manicure can set his/her hands on the top/work surface and forearms on one sloped surface while receiving the manicure and the manicurist's hands, wrists and forearms can be supported by the other sloped surface and the top/work surface while performing the manicure.

5. A device according to claim 4 wherein the means for allowing the vent system built into the table to continue its function unimpaired is a plurality of air ports passing through the device from the top/working surface to the bottom surface in a pattern designed to allow adequate air to be displaced by the vent system for the vent system to function properly and to allow easy alignment of the device on the table with the built in vent system.

6. In a device for use by a manicurist with a dina meri® Portable Nail Air Filter System while giving another person a manicure while having a table to work on, the device comprising:

a) means for comfortably supporting the hands, wrists and forearms of the manicurist;

b) means for supporting the hands, wrists and forearms of the person receiving the manicure;

so as to allow the device to be placed around the dina meri® Portable Nail Air Filter System between the manicurist and the other person so that the person receiving the manicure can set his/her fingers on top of the dina meri ® Portable Nail Air Filter System and rest his/her hands, wrists and forearms on the device so as to provide comfortable support for the person receiving the manicure and to allow the manicurist to support her hands, wrists and forearms on the device while giving the manicure.

7. A device according to claim 6 further comprising means for allowing the vent system of the dina meri ® Portable Nail Air Filter System to continue its function unimpaired.

8. A device according to claim 6 wherein the device is composed of resilient material.

9. A device according to claim 8 wherein the device is composed of ethylene vinyl acetate.

10. A device according to claim 6 further comprising:

a) a cavity in the body of the device wherein the dina meri ® Portable Nail Air Filter System can be placed;

b) two sloped surfaces which extend from the two opposite upper edges of the dina meri ® Portable Nail Air Filter System which are intended to face the manicurist and the person receiving the manicure while in use, to a location a short distance from the dina meri ® Portable Nail Air Filter System and at least in close proximity to the table so as to from a gradual incline plane between the table top and the top of the dina meri ® Portable Nail Air Filter System;

such that the person receiving the manicure can lay their fingers on top of the dina meri ® Portable Nail Air Filter System, and rest their hands, wrists and forearms on one sloped surf ace while receiving the manicure and the manicurist's hands, wrists and forearms can be supported by the other sloped surface and top/work surface while performing the manicure.

11. A device according to claim 6 further comprising means for allowing the vent system of the dina meri ® Portable Nail Air Filter System to continue its function unimpaired while a manicure is being given.

12. In a device for use by a manicurist while performing a manicure on another person's nails while having a surface such as that provided by a table to place the device on, the device comprising:

a) a bottom surface;

b) a top/work surface which is smaller than the bottom surface;

c) two side walls of equal size and shape located on opposite sides of the device, with each side wall connecting the top/work surface to the bottom surface;

d) two sloped surfaces on opposite ends of the device connecting the bottom surface to the top/work surface;

so as to allow the bottom surface of the device to be placed on the table's surface in between the manicurist and the person receiving the manicure, to further allow the hand receiving the manicure to be placed on the device's top/work surface and the forearm of the hand receiving the manicure to be placed on one sloped surface, thereby providing comfortable support for the person receiving the manicure while raising the hand receiving the manicure, and further providing a place for a manicurists to support his/her hands and wrists on the other sloped surface while preforming the manicure so as to help avoid any discomfort, strain or pain by the manicurist in his/her hands, wrists, neck or back while working on the project.

13. A device according to claim 12 wherein the device is composed of a resilient material.

14. A device according to claim 13 wherein:

a) the bottom surface is flat and has four edges;

b) the top/work surface is parallel to the bottom surface and has four edges;

c) the two side walls have four edges, with each side wall connecting opposite edges of the top/work surface to opposite edges of the bottom surface;

d) the two sloped suffices have four edges connecting the remaining two opposite edges of the bottom surface to the remaining two opposite edges of the top/work surface.

15. A device according to claim 14 wherein the device is composed of ethylene vinyl acetate.

* * * * *